US006669559B1

(12) United States Patent
Baerlocher et al.

(10) Patent No.: US 6,669,559 B1
(45) Date of Patent: Dec. 30, 2003

(54) GAMING DEVICE WITH BONUS SCHEME PROVIDING INCREASED REWARD FOR SELECTING RELATED SYMBOLS

(75) Inventors: Anthony J. Baerlocher, Reno, NV (US); Cari L. Blomquist, Reno, NV (US); Lance R. Peterson, Reno, NV (US)

(73) Assignee: IGT, Reno, NV (US)

( * ) Notice: Subject to any disclaimer, the term of this patent is extended or adjusted under 35 U.S.C. 154(b) by 145 days.

(21) Appl. No.: 09/605,023

(22) Filed: Jun. 28, 2000

(51) Int. Cl.[7] ..... A63F 9/22
(52) U.S. Cl. ..... 463/16; 463/25
(58) Field of Search ..... 463/9–11, 12–13, 463/16–20, 25–27, 30, 31, 35; 273/138.1, 139, 143 R, 236, 237, 273, 292; 283/903

(56) References Cited

U.S. PATENT DOCUMENTS

| | | | | |
|---|---|---|---|---|
| 1,527,929 A | * | 2/1925 | Simons | 283/903 |
| 4,695,053 A | | 9/1987 | Vazquez | |
| 5,449,173 A | * | 9/1995 | Thomas et al. | 273/143 R |
| 5,536,016 A | | 7/1996 | Thompson | |
| 5,707,285 A | * | 1/1998 | Place et al. | 463/12 |
| 5,902,184 A | | 5/1999 | Bennett et al. | |
| 6,015,346 A | | 1/2000 | Bennett | |
| 6,033,306 A | * | 3/2000 | De Souza | 463/18 |
| 6,056,642 A | | 5/2000 | Bennett | |
| 6,059,289 A | * | 5/2000 | Vancura | 273/143 R |
| 6,089,976 A | | 7/2000 | Schneider et al. | |
| 6,102,798 A | | 8/2000 | Bennett | |
| 6,203,429 B1 | * | 3/2001 | Demar et al. | 463/20 |
| 6,322,309 B1 | * | 11/2001 | Thomas et al. | 463/25 |
| 6,346,043 B1 | | 2/2002 | Colin et al. | |
| 6,347,996 B1 | | 2/2002 | Gilmore et al. | |

FOREIGN PATENT DOCUMENTS

| | | |
|---|---|---|
| EP | 0945837 A2 | 9/1999 |
| EP | 0984408 A2 | 3/2000 |

OTHER PUBLICATIONS

MONOPOLY, <http://www.monopoly.com>, downloaded from the Internet on Nov. 5, 2002, pp. 1–10.*

TIC TAC DOUGH©, Jack Barry & Dan Enright Productions; a division of Sony Pictures Entertainment, <www.angelfire.com/–wrestling3/jay_anton/tictacpages/tictacdough.html> (1978).*

* cited by examiner

*Primary Examiner*—Mark Sager
*Assistant Examiner*—Steven Ashburn
(74) *Attorney, Agent, or Firm*—Bell, Boyd & Lloyd LLC

(57) ABSTRACT

The present invention relates to a bonus scheme for a gaming device which presents a plurality of selections to a player. When a player chooses a selection, the game exhibits a non-terminating symbol or a terminating symbol. Certain non-terminating symbols are related to other non-terminating symbols. The game awards the player with a basic value when the player chooses selections which are associated with non-terminating symbols. In addition, the game awards the player with a match value when the player chooses a selection and the game exhibits a symbol which is related to another exhibited symbol. The bonus round terminates when the player ultimately chooses a selection associated with a terminating symbol. Accordingly, the player is faced with an array of selections with the aim of locating as many related non-terminating symbols as possible, before reaching a terminating symbol. The game may also award a basic value to the player when the player chooses a selection associated with a terminating symbol.

8 Claims, 9 Drawing Sheets

FIG. 4A

52

| | | |
|---|---|---|
| Selection | Selection | Selection |
| Selection | Selection | Selection |
| Selection | Selection | Selection |

FIG. 4B

66

| | | |
|---|---|---|
| Selection | Selection | Selection |
| Selection | Selection | Selection |
| Selection | Selection | ********* Terminating Symbol |

FIG. 4C

70

| | | |
|---|---|---|
| Selection | Selection | Selection |
| ********* Non-Terminating Symbol "A" | Selection | Selection |
| Selection | Selection | Selection |

FIG. 4D

76

| | | |
|---|---|---|
| Selection | Selection | ********* Non-Terminating Symbol "A" |
| ********* Non-Terminating Symbol "A" | Selection | Selection |
| Selection | Selection | Selection |

FIG. 5

78

| RELATED SYMBOLS | MATCH VALUES |
|---|---|
| A | 100 |
| B | 50 |
| C | 45 |
| D | 35 |
| E | 30 |
| F | 25 |
| G | 20 |
| H | 15 |

GAMING DEVICE WITH BONUS SCHEME PROVIDING INCREASED REWARD FOR SELECTING RELATED SYMBOLS

CROSS-REFERENCE TO RELATED APPLICATIONS

This application is related to the following commonly-owned co-pending patent applications: "GAMING DEVICE HAVING A MULTIPLE SELECTION GROUP BONUS ROUND," Ser. No. 09/605,107, "GAMING DEVICE HAVING A BONUS SCHEME WITH SYMBOL GENERATOR AND SYMBOL TERMINATING CONDITION," Ser. No. 09/652,312, "GAMING DEVICE HAVING MULTIPLE AUDIO, VIDEO OR AUDIO-VIDEO EXHIBITIONS ASSOCIATED WITH RELATED SYMBOLS," Ser. No. 09/689,529, and "GAMING DEVICE HAVING MULTIPLE CHOICE LARGE AWARD BONUS SCHEME," Ser. No. 09/686,284,

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a bonus scheme wherein players receive a reward for selecting certain symbols and an increased reward for selecting symbols which are related to one another.

BACKGROUND OF THE INVENTION

Gaming machines currently exist with bonus schemes in which the player has one or more opportunities to choose a particular selection or symbol from a group of symbols. When a player chooses a symbol, the bonus scheme will either award the player with a bonus value or terminate the bonus round. The outcome depends upon the particular symbol selected by the player.

When the player selects a symbol which awards a bonus value, the player receives bonus credits, and the player has another chance to select another symbol. Each time the player selects a symbol which awards a bonus value, the bonus scheme typically displays a message for the player to continue. This message means that the bonus round continues and the player may now choose another symbol. The player then selects another symbol, and this process continues until the player selects a bonus round terminator which terminates the bonus round. European Patent Application No. EP 0 945 837 A2 filed on Mar. 18, 1999 and assigned on its face to WMS Gaming, Inc. discloses a bonus scheme generally of this type.

To increase player enjoyment and excitement, it is desirable to provide players with new bonus schemes where the players have multiple opportunities to receive winning payouts. In particular, it is desirable to incorporate the excitement of matching games, such as the traditional "go fish" and "concentration" card games into bonus schemes. As players select certain items out of a large array of items, players feel a heightened experience of anticipation and excitement which they do not experience with many currently existing bonus schemes.

SUMMARY OF THE INVENTION

The present invention overcomes the above shortcomings by providing a gaming device and method which provides players with an increased reward for locating certain symbols which are related to each other. The term "symbol", as used herein, means any image or sound in any form. The term "related", as used herein, means belonging to a predetermined set for any logical or illogical reason, including, without limitation, because of identical or matching images, visual characteristics or sounds. The term "exhibit", as used herein, means to visually display, audibly play or display or play in audio, visual or audio-visual form.

The bonus scheme of the present invention provides a player with a plurality of selections. Each selection is associated with its own symbol. The game conceals which symbol is associated with each selection. When a player chooses a selection, the game exhibits one or more symbols associated with the selection using a display device. Preferably, the majority of the symbols are related to other symbols. Certain symbols, which are preferably unrelated to any other symbol, when exhibited by the game, will terminate the bonus round (hereinafter referred to as "terminating symbols"). However, it should be appreciated that the bonus scheme could include certain non-terminating symbols which are not related to any other symbol. Whenever the game exhibits any nonterminating symbol (whether related or unrelated), preferably the game will award the player with a bonus value (hereinafter referred to as a "basic value") and then continue the bonus round. When the game exhibits a symbol which is related to another exhibited symbol, the game will award the player with a bonus value in an amount greater than any basic value (hereinafter referred to as a "match value") and then continue the bonus round. Depending upon which selection the player chooses, the game may award the player with a basic value, match value, a combination of the two, or the bonus round may terminate.

Preferably all of the symbols used in any particular bonus round includes one terminating symbol which is not related to any other symbol, and a plurality of non-terminating symbols which are related to at least one other symbol. Preferably, the related symbols are separately paired. For example, two related symbols can have the same shape, make the same sound, have the same color, or be of a dual set (i.e., a horse and a buggy).

In operation, a player chooses a selection. If the game exhibits a non-terminating symbol, preferably the game awards the player with a basic value. As long as the player avoids a terminating symbol, after each choice the player chooses another selection. Whenever the player chooses a selection associated with a non-terminating symbol, preferably the game awards the player with another basic value. In addition, if at any time, symbols which the game has thus far exhibited are related, the game awards the player with a match value.

As long as the player does not choose a selection associated with a terminating symbol, the game enables the player to choose another selection. The player will receive any basic values and match values as appropriate. This process continues until the player ultimately chooses a selection associated with a terminating symbol or until the player chooses all of the related symbols.

According to one embodiment of the present invention, the selections are represented by squares in a grid. Each square is identical in appearance. A player chooses a selection by "touching" a square on a touch screen, and the game exhibits a symbol.

The symbols may be represented by characters which appear in the squares, including people and animals. In one preferred embodiment, the non-terminating symbols consist of characters in pairs. Characters which are related to one another are paired with one another. Preferably, the characters in a pair have an identical appearance.

The terminating symbol is represented by an unmatched character (i.e., which is not paired with any other character). In addition, it is preferable that the bonus scheme includes a relationship table displayed on a screen. The relationship table is a source of information for the player which illustrates the match value corresponding to each character.

In operation, a player chooses a square and a character appears. If the character is the unmatched character, preferably the game awards the player with a basic value, and then the bonus round terminates. If the character is not the unmatched character, the game awards the player with a basic value and enables the player to choose another square.

As the player continues to choose squares (avoiding the unmatched character), whenever the game exhibits a pair of characters, the game awards the player with a match value. This process continues with additional choices until the player chooses a square associated with the unmatched character.

As long as the player avoids the unmatched character, the player will receive basic values and match values as appropriate. Eventually, the player will choose a square associated with the unmatched character, and the bonus round will terminate. The game then awards the player with any basic value, match value and credits which the player gained.

It is therefore an object of the present invention to provide a gaming device with a bonus scheme which provides an increased reward for selecting symbols which are related to one another.

Another object of the present invention is to provide a gaming device wherein the player, desiring to locate related symbols, must decide which selection to choose out of a relatively large array of selections.

Yet another object of the present invention is to provide a gaming device and method wherein the player experiences anticipation and excitement when contemplating which selection to choose out of a relatively large array of selections.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 4*a*, 4*b*, 4*c* and 4*d* are top plan views of the selections and symbols in one embodiment of the bonus scheme of the present invention;

FIG. 5 is a top plan view of a relationship or pay table in one embodiment of the bonus scheme of the present invention.

DETAILED DESCRIPTION OF THE INVENTION

Gaming Device and Electronics

Figure 1:
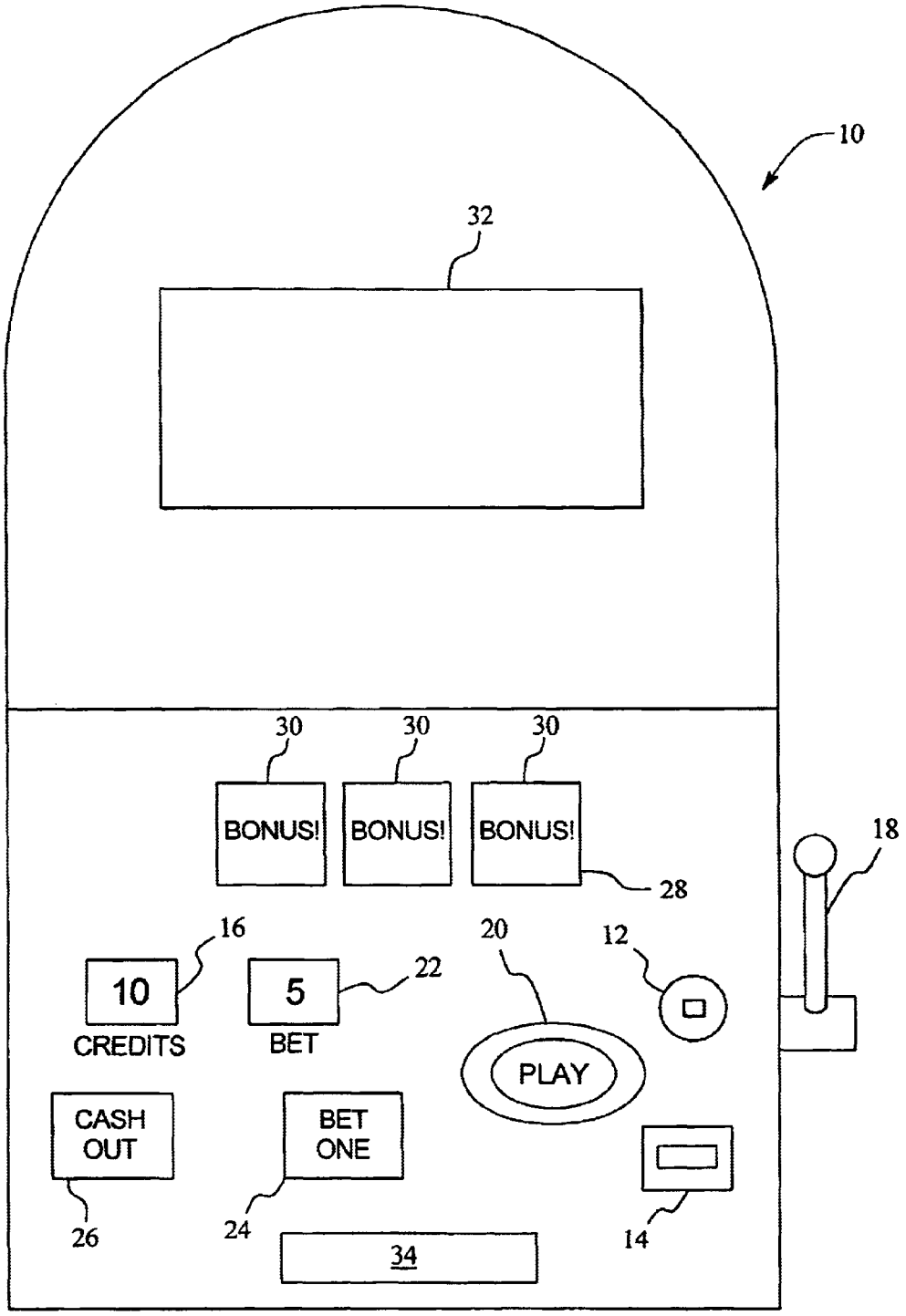
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28.

At any time during the game, a player may "cash out" and thereby receive a number of coins corresponding to the number of remaining credits by pushing a cash out button 26. When the player "cashes out," the player receives the coins in a coin payout tray 34. The gaming device 10 may employ other payout mechanisms such as credit slips redeemable by a cashier or electronically recordable cards which keep track of the player's credits.

Figure 2:
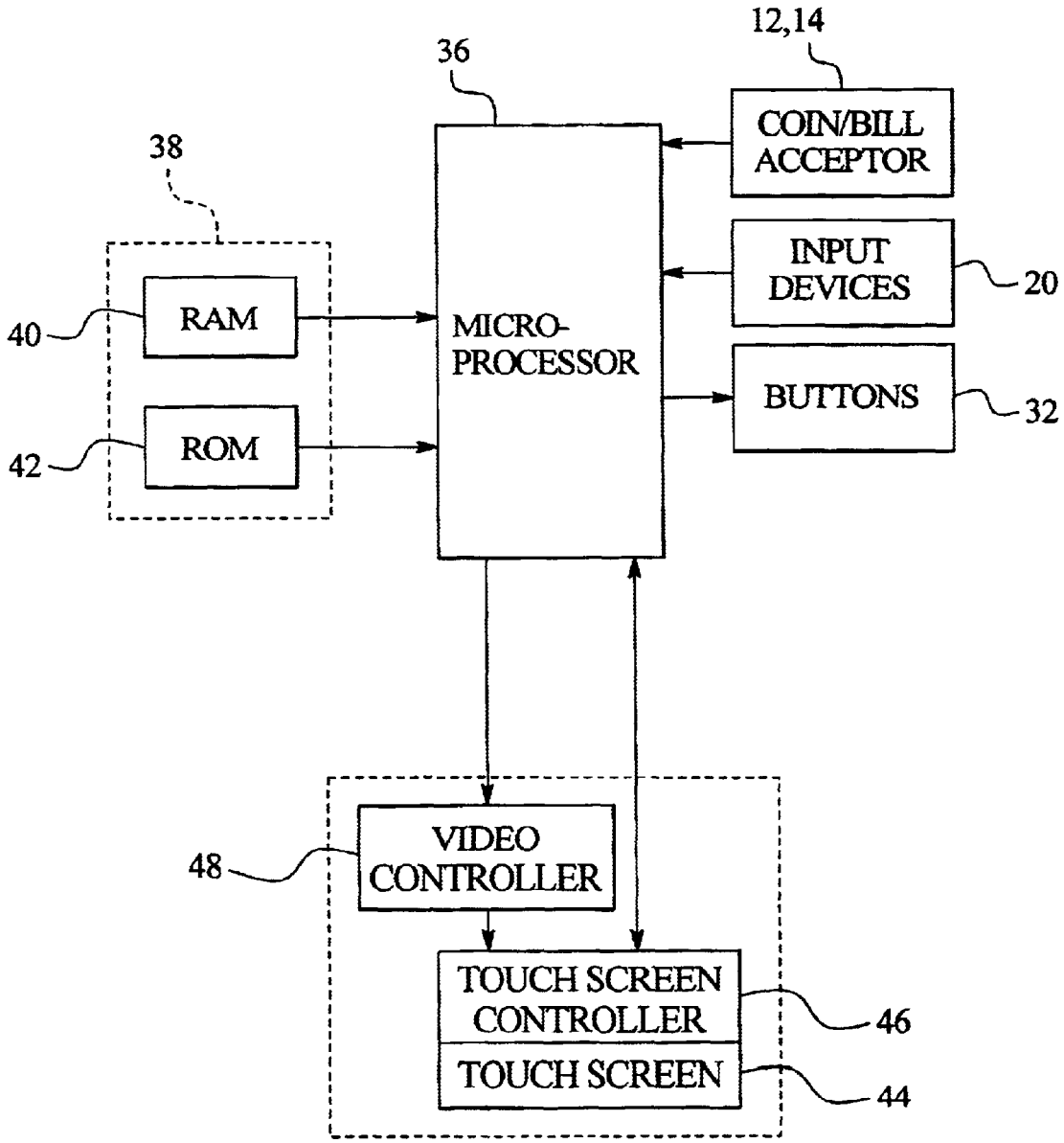
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 36, a memory device 38 for storing program code or other data, a video monitor 32 or other display device (i.e., a liquid crystal display) and at least one input device such as play buttons 20. The processor 36 is preferably a microprocessor or microcontroller-based platform which is capable of displaying images, symbols and other indicia such as images of people, characters, places, things and faces of cards. The memory device 38 can include random access memory (RAM) 40 for storing event data or other data generated or used during a particular game. The memory device 38 can also include read only memory (ROM) 42 for storing program code which controls the gaming device 10 so that it plays a particular game in accordance with applicable game rules and pay tables.

As illustrated in FIG. 2, the player preferably uses play buttons 20 to input signals into gaming device 10. Furthermore, it is preferable that touch screen 44 and an associated touch screen controller 46 are used instead of a conventional video monitor 32. Touch screen 44 and touch screen controller 46 are connected to a video controller 48 and processor 36. A player can make decisions and input signals into the gaming device 10 by touching touch screen 44 at the appropriate places. As further illustrated in FIG. 2, the processor 36 can be connected to coin slot 12 or bill acceptor 14. The processor 36 can be programmed to require a player to deposit a certain amount of money in order to start the game.

It should be appreciated that although a processor 36 and memory device 38 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 36 and memory device 38 preferably reside on each gaming device 10 unit, it is possible to provide some or all of their functions at a central location such as a network server for communication to a playing station such as over a local area network (LAN), wide area network (WAN), Internet connection, microwave link, and the like. The processor 36 and memory device 38 are generally referred to herein as the "computer."

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on the display window 28. The gaming device 10 also includes a display device such as a video monitor 32 shown in FIG. 1. The display device visually displays images and produces sounds, enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Scheme

If a player achieves a bonus triggering or qualifying condition while playing the game, the gaming device 10 automatically begins the bonus round of the present invention. As indicated by block 50 in FIG. 3, the bonus round of the present invention begins by providing a player with a plurality of selections on a display device. The selections are images consisting of varying graphics and having various sizes, shapes and colors. In one embodiment of the present invention, the selections are squares in a grid 52 as illustrated in FIG. 4*a*. However, it should be appreciated that the selections can be separated and spaced apart in an orderly or disorderly fashion.

Figure 3:
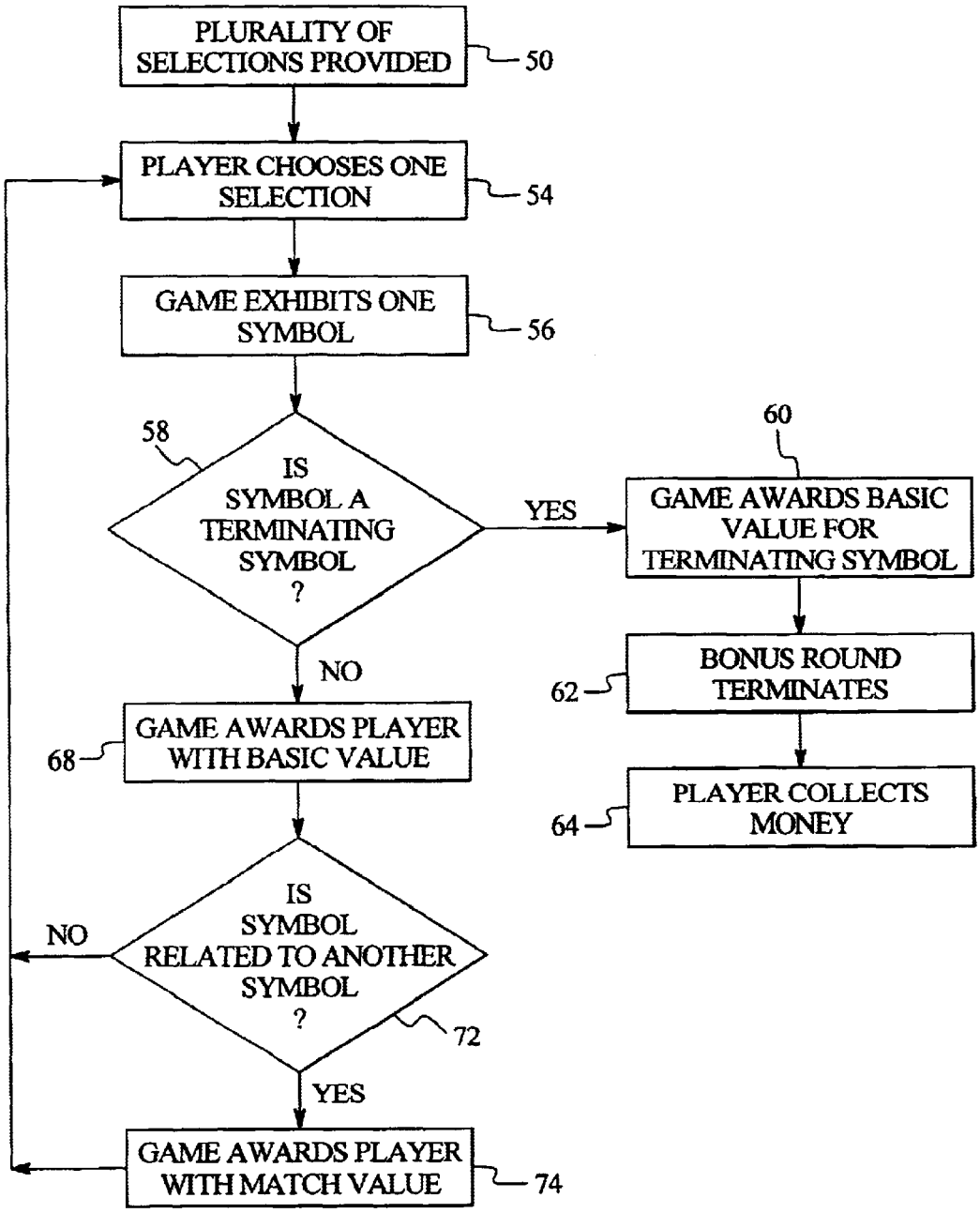
FIG. 3 is a flow diagram of one embodiment of the bonus scheme of the present invention.

After reviewing the plurality of selections, the player chooses one selection by touching touch screen 44 (illustrated in FIG. 2) which displays the selections, as indicated by block 54 in FIG. 3. Each time a player chooses a selection, the game exhibits one symbol as indicated by block 56 in FIG. 3. The symbol is either a non-terminating symbol or a terminating symbol. The bonus scheme includes a plurality of non-terminating symbols. Preferably the bonus scheme includes only one terminating symbol, however more than one terminating symbol can be used.

Certain non-terminating symbols are related to other symbols. Preferably the related symbols have identical characteristics and are grouped by the nature of their characteristics. For example: (i) one set could be designated for red-colored symbols and another set could be designated for blue-colored symbols; or (ii) one set could be designated for symbols which make the sound of a trumpet, and another set could be designated for symbols which make the sound of a piano.

It should also be appreciated that other related symbols can have no similarities but nonetheless belong to the same predetermined set. These symbols can be logically related, for example: a horse and buggy, drum sticks and a drum, or a rabbit and carrot. However, they can also be arbitrarily related in a predetermined set with no apparent logical relationship, such as a tree and a balloon. The predetermined sets are programmed into the computer of the gaming device 10 (shown in FIG. 1).

Preferably, the sets are pairs, and within each pair the two related symbols have an identical appearance. For example, pairs could be designated for the letters of the alphabet (i.e., a pair of A's, a pair of B's, or a pair of C's). It should be appreciated that, although pairs are preferable, the sets can include any number of related symbols.

The game preferably awards a basic value to the player each time the player locates certain symbols, and preferably, the game awards a basic value for all symbols. Also, preferably the basic values are the same amount for all symbols (i.e., 1 point). It should be appreciated, though, that basic values can vary from symbol to symbol and can increase as the bonus round is played.

Furthermore some, and preferably all, of the related symbols are associated with certain match values. The game awards a match value to the player each time the game exhibits a symbol which is related to another exhibited symbol (previously selected by the player). Therefore, the game awards the player with one value for each choice, and awards the player with a higher value when the player chooses a selection which causes the game to exhibit a symbol which is related to another exhibited symbol.

Referring again to FIG. 3, after the player chooses a selection, if at any time the game exhibits a terminating symbol, the game preferably awards the player with a basic value associated with the terminating symbol as indicated by diamond 58 and block 60. The bonus round then terminates, as indicated by block 62. Finally, the player can collect any money due to the player as indicated by block 64. A terminating symbol is generally illustrated in grid 66 in FIG. 4*b* (i.e., the player chose the selection in the third column and third row.)

If the symbol is a non-terminating symbol (instead of a terminating symbol), the game preferably awards the player with a basic value as indicated by diamond 58 and block 68. A non-terminating symbol "A" is generally illustrated in grid 70 in FIG. 4*c* (i.e., the player chose the selection in the first column and second row.) The basic value is then preferably displayed on the display device.

As indicated by diamond 72 in FIG. 3, if the player chooses a selection which is not a terminating symbol and which does not cause the game to exhibit related symbols, the game enables the player to choose another selection. Obviously, upon the player's first choice, the game will not award a match value to the player but preferably awards a basic value. This is because the non-terminating symbol is the sole exhibited symbol and therefore cannot yet be related to another exhibited symbol.

After the game has exhibited the first non-terminating symbol, the player then has the opportunity to win match values. If the player chooses a selection and the game exhibits a non-terminating symbol which is related to another symbol which the game has already exhibited, the game awards the player with a match value associated with the related symbols, as indicated by block 74. A non-terminating symbol "A" related to another non-terminating symbol "A" is generally illustrated in grid 76 in FIG. 4*d* (i.e., in a previous choice, the player chose the selection in the first column and second row, and the player later chose the selection in the third column and first row.)

Eventually the player will choose a selection associated with a terminating symbol. Bonus rounds preferably end in this manner. Whether the player reaches a terminating symbol on a first choice or last choice depends upon which selections the player decides to choose.

It is preferred that the bonus scheme of the present invention displays a pay table 78, illustrated in FIG. 5. The non-terminating symbols are represented in FIG. 5 as letters of the alphabet. Adjacent to each non-terminating symbol is a match value. In the example illustrated in FIG. 5, when a player locates an "A" after having already located one or more "A's", the game awards the player with a match value in the amount of one hundred points. Pay table 78 adds excitement to the bonus scheme of the present invention by informing the player of the relative importance of locating certain non-terminating symbols.

It should be appreciated, however, that the match values need not be fixed and displayed in pay table 78. Furthermore, various symbol values can be associated with the related symbols, and the match value can be the sum of these symbol values. The computer of the gaming device can generate symbol values and match values derived from other predetermined sets of values or by using random generation and other techniques. For example, when a player locates an "A" for the first time, the computer randomly generates a symbol value from a predetermined set of values. When a player locates another "A," the computer randomly generates another symbol value from a predetermined set of values. The computer then adds the first symbol value to the second symbol value and awards this sum to the player as a match value. In another example, the player receives no value until the player reaches a match. When the player reaches a match, the computer randomly generates a match value from a predetermined set of values and then awards this match value to the player.

If the symbols in a bonus scheme of the present invention are images, preferably each time a new bonus round begins, the game rearranges the symbols. The rearrangement prevents the symbols from being located in the same place on the display device from bonus round to bonus round. Therefore, this prevents players from increasing their odds of success by memorizing the location of symbols.

The bonus scheme of the present invention offer players with a heightened level of excitement because the player does not know what is "behind" each selection. The game offers the player an array of selections. When the player chooses a selection, the player is faced with several possible outcomes: (i) the player could reach a terminating symbol, terminating the bonus round; (ii) the player could reach a nonterminating symbol, providing the player with a basic value; or (iii) the player could reach a non-terminating symbol which is related to another non-terminating symbol, providing the player with a match value. The possibility that one touch on touch screen 44 (illustrated in FIG. 2) could bring instant success, failure or various awards is exciting and generally pleasurable to players.

In one preferred embodiment of the present invention, the symbols in the bonus scheme of the present invention are images, and specifically they are characters. The characters are people and animals, preferably in cartoon form. Furthermore, in this preferred embodiment certain characters are related because they are identical in appearance (i.e., twins). The related characters are paired by character type. For example, red-headed twins would make one pair and bald-headed twins would make another pair.

Figure 6:
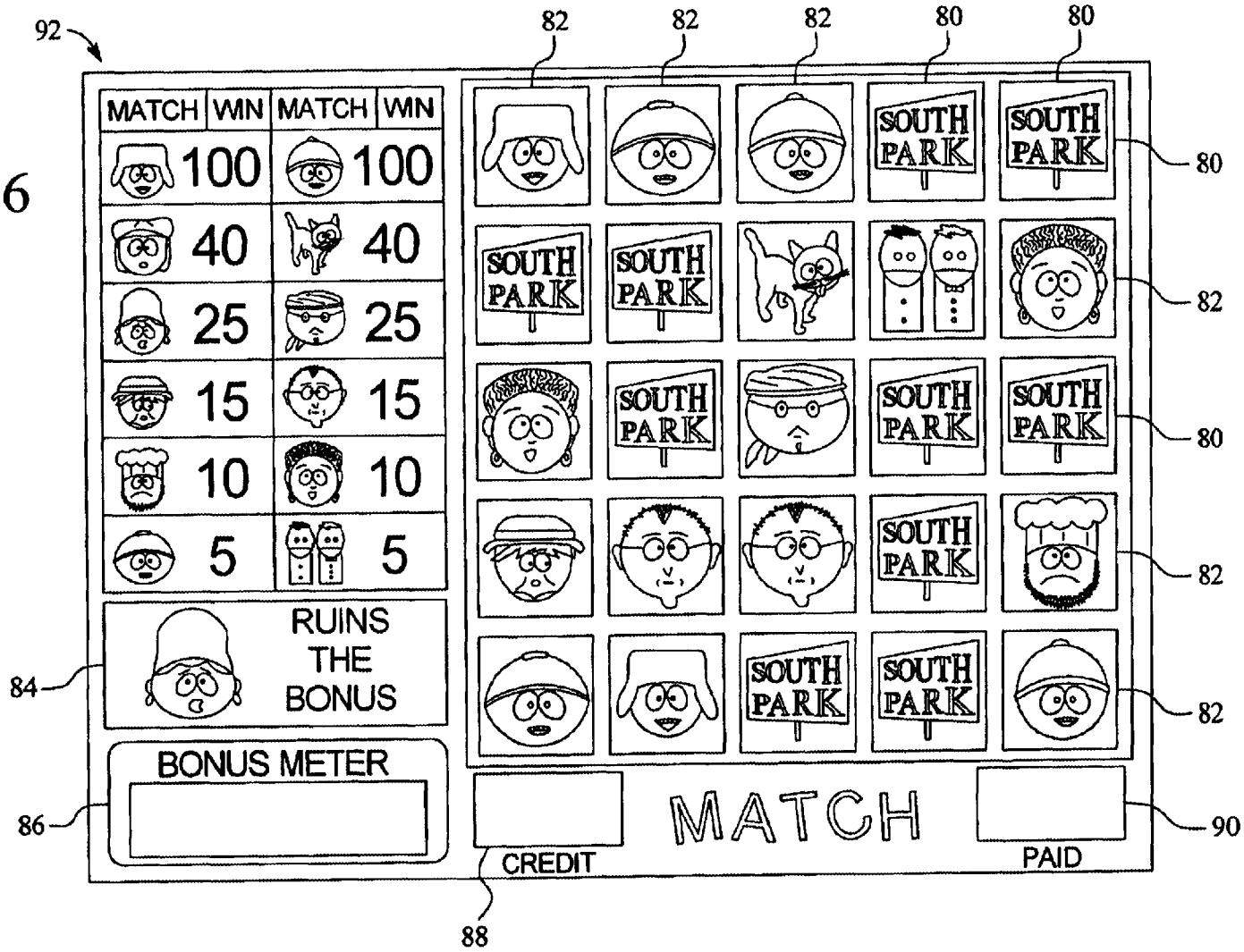
FIG. 6 is a top plan view of an alternative embodiment of the selections and symbols of the bonus scheme of the present invention.

As illustrated in FIG. 6, the selections are displayed as indicia 80, shaped in squares and located in a five by five grid which provides twenty-five selections. Indicia 80 includes a yard sign bearing a message. At the beginning of the bonus round, all of the squares in the five by five grid display the identical indicia 80.

The non-terminating symbols include twenty-four characters 82, some of which are identified in FIG. 6. In the preferred embodiment, there is only one terminating symbol, terminating character 84. All twenty-five symbols are located "behind" indicia 80 in the five by five grid shown in FIG. 6.

In the bonus round illustrated in FIG. 6, a player has chosen fifteen indicia 80, and the game has displayed fifteen non-terminating characters 80. The game has already awarded the player with basic values for the fifteen non-terminating characters 82. Five of the fifteen non-terminating characters are identical to another non-terminating character which appears in the five by five grid. In particular the following characters are identical (where the column number is first and row number is second): (i) characters located at 1×1 and 2×5; (ii) characters located at 2×1 and 1×5; (iii) characters located at 3×1 and 5×5; (iv) characters located at 5×2 and 1×3; and (v) characters located at 2×4 and 3×4.

Therefore, the player has achieved five "matches," and the game has awarded the player with match values for the five "matches." Because there are twenty-four symbols, the maximum amount of "matches" the player could obtain is twelve. Consequently, the player has the opportunity to achieve seven additional matches as long as the player avoids the terminating character.

Because the player has thus far successfully avoided terminating character 84, terminating character 84 is not displayed in the five by five grid. Eventually, the player will choose an indicia 80, and the terminating character 84 will appear in the place of the indicia 80. The player will receive a basic value for the terminating character and the bonus round will then terminate.

Bonus meter 86 displays a running total of all basic values and match values which the player gains. The game displays the credit points which the player gained at credit meter 88. The game also displays the amount of money due to the player in the paid window 90 illustrated in FIG. 6.

Furthermore, a match table 92 is shown to the left of the five by five grid in FIG. 6. This match table 92 displays each non-terminating character 82 adjacent to its associated match value. The player can view match table 92 and know the various match values which the player can win by "matching" certain non-terminating characters 82.

In addition, the preferred embodiment displays the terminating character 84 as shown in FIG. 6 outside of the five by five grid. Preferably, a phrase is located near the failure character 84 which informs the player that the game will terminate if the player locates the terminating character 84 on the five by five grid. As shown in FIG. 6, this phrase is "RUINS THE BONUS."

As is apparent by viewing FIG. 6, the preferred embodiment. of the bonus scheme preferably incorporates a South Park cartoon theme. SOUTH PARK™ is a trademark and service mark of Comedy Partners, New York, N.Y., and is used with permission from Comedy Partners by the assignee of the present invention. In addition, the preferred embodiment can include audio features (i.e., songs, voices, and other sound effects) which are consistent with the cartoon theme of this preferred embodiment.

In one alternative embodiment of the present invention, the game awards the player with a consolation value. The game awards a player with a consolation value when the bonus round terminates and preferably when the player chooses a terminating symbol. This consolation value can be any predetermined or randomly generated value.

In another alternative embodiment of the present invention, the game awards the player with a bonus value for choosing certain non-terminating unrelated symbols. This bonus value is preferably greater than any basic value. It should be appreciated, however, that this bonus value can be any amount and can be determined in any manner. For example, this bonus value can be the product of a predetermined numeric factor (i.e., two) multiplied by the sum of all values awarded to the player thus far in the bonus round. In another example, this bonus value can be any predetermined number.

Figure 7:
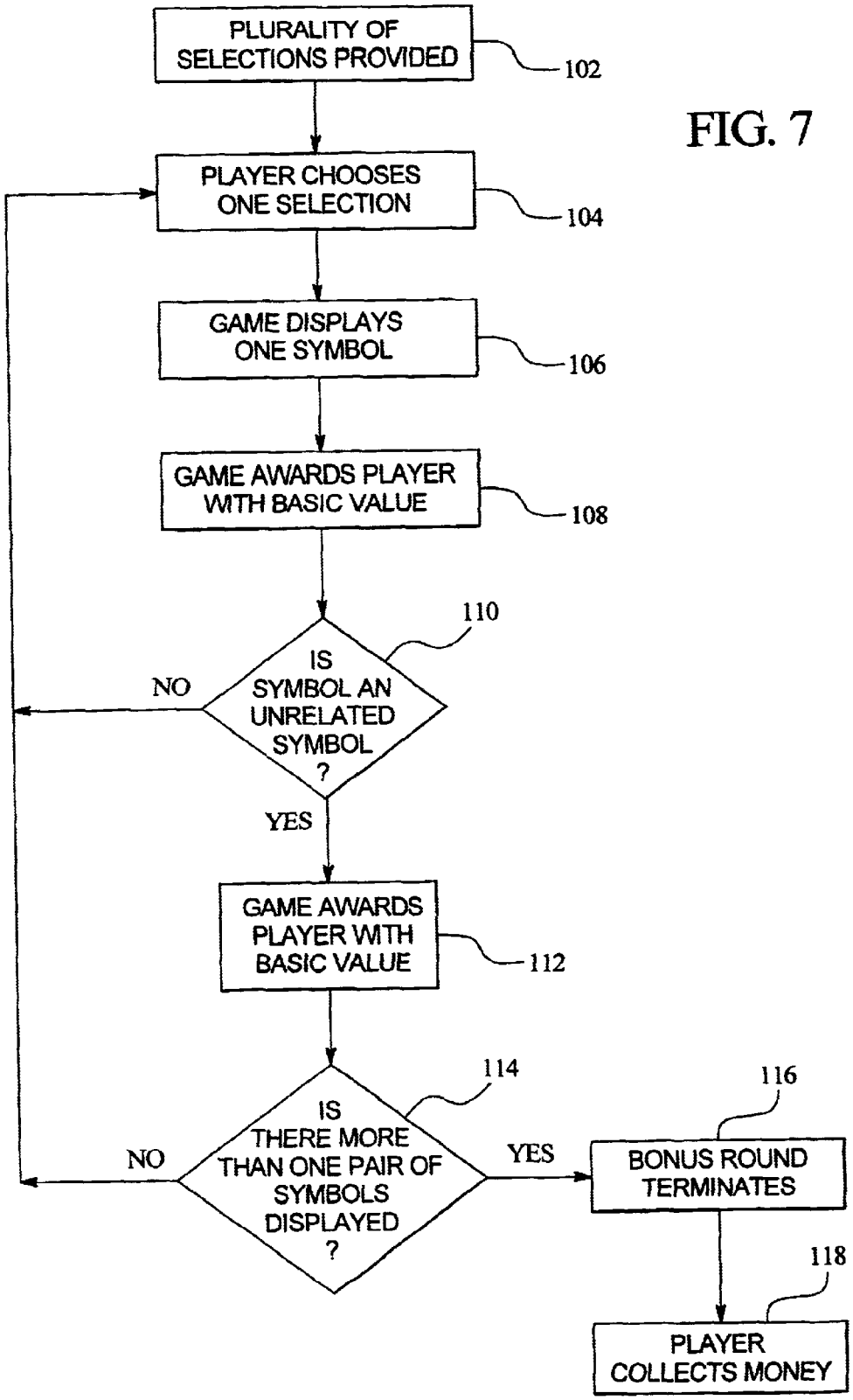
FIG. 7 is a flow diagram of one embodiment of the bonus scheme of the present invention.
Figure 8:
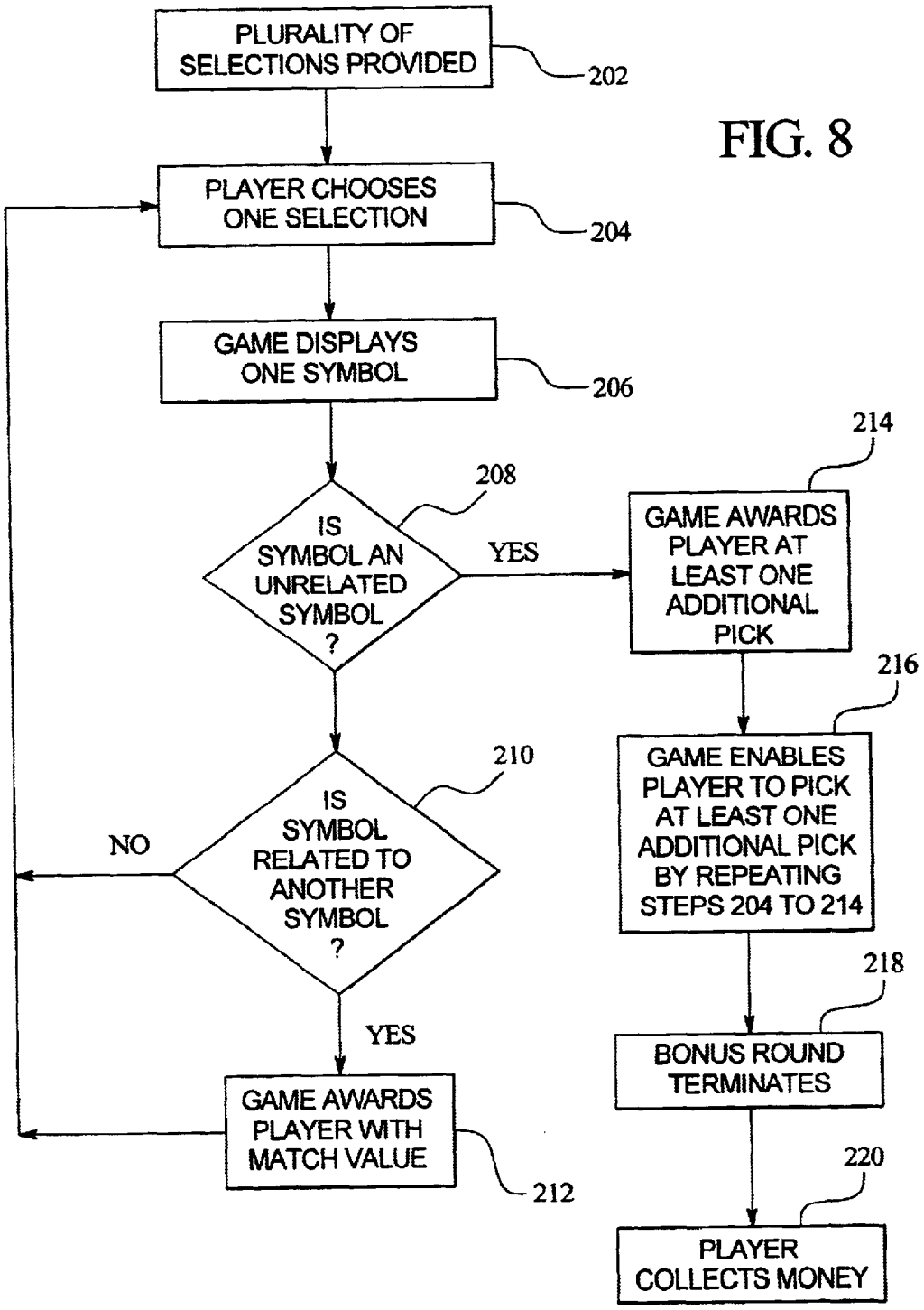
FIG. 8 is a flow diagram of one embodiment of the bonus scheme of the present invention.
Figure 9:
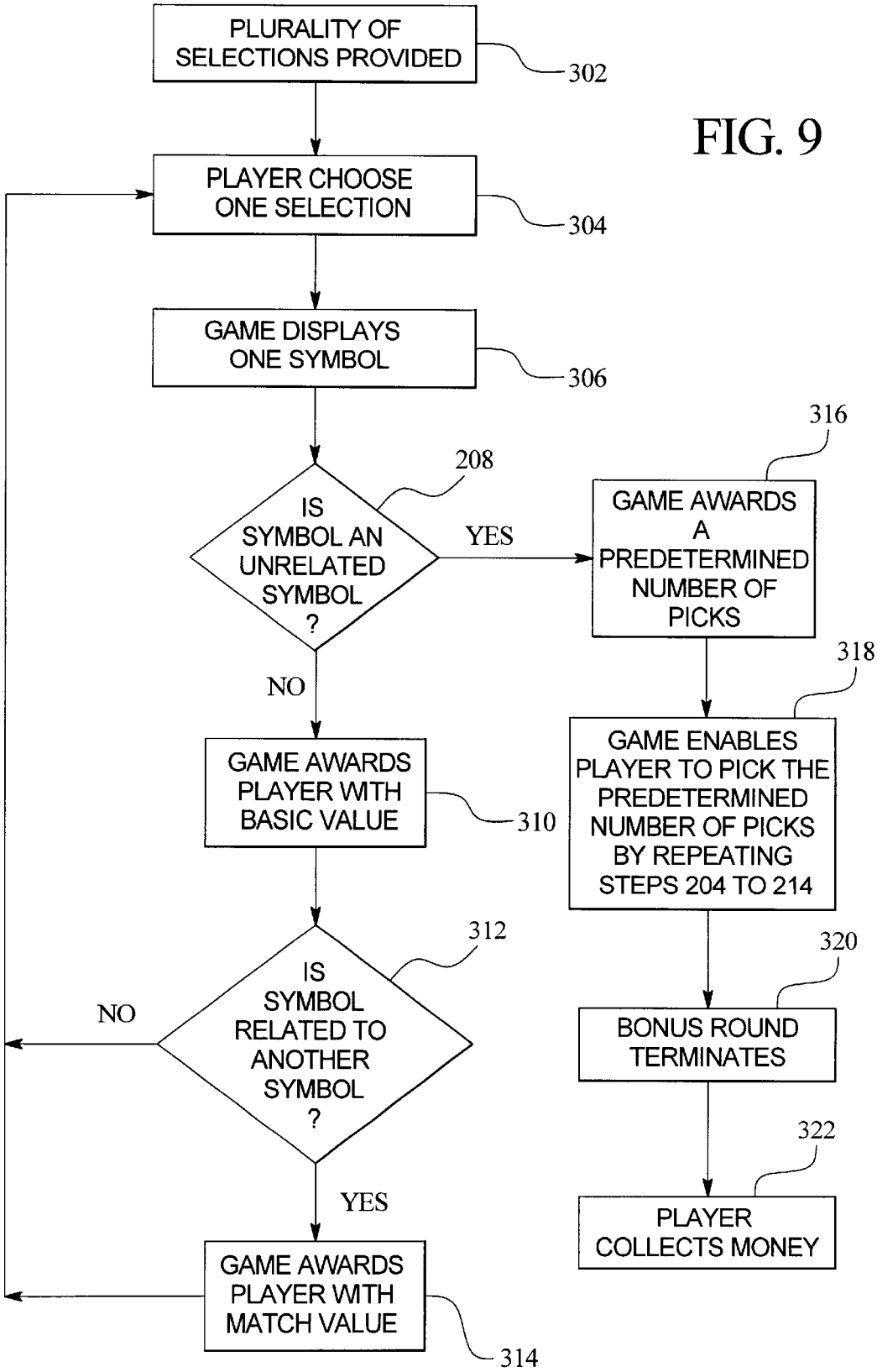
FIG. 9 is a flow diagram of one embodiment of the bonus scheme of the present invention.3
Figure 9:
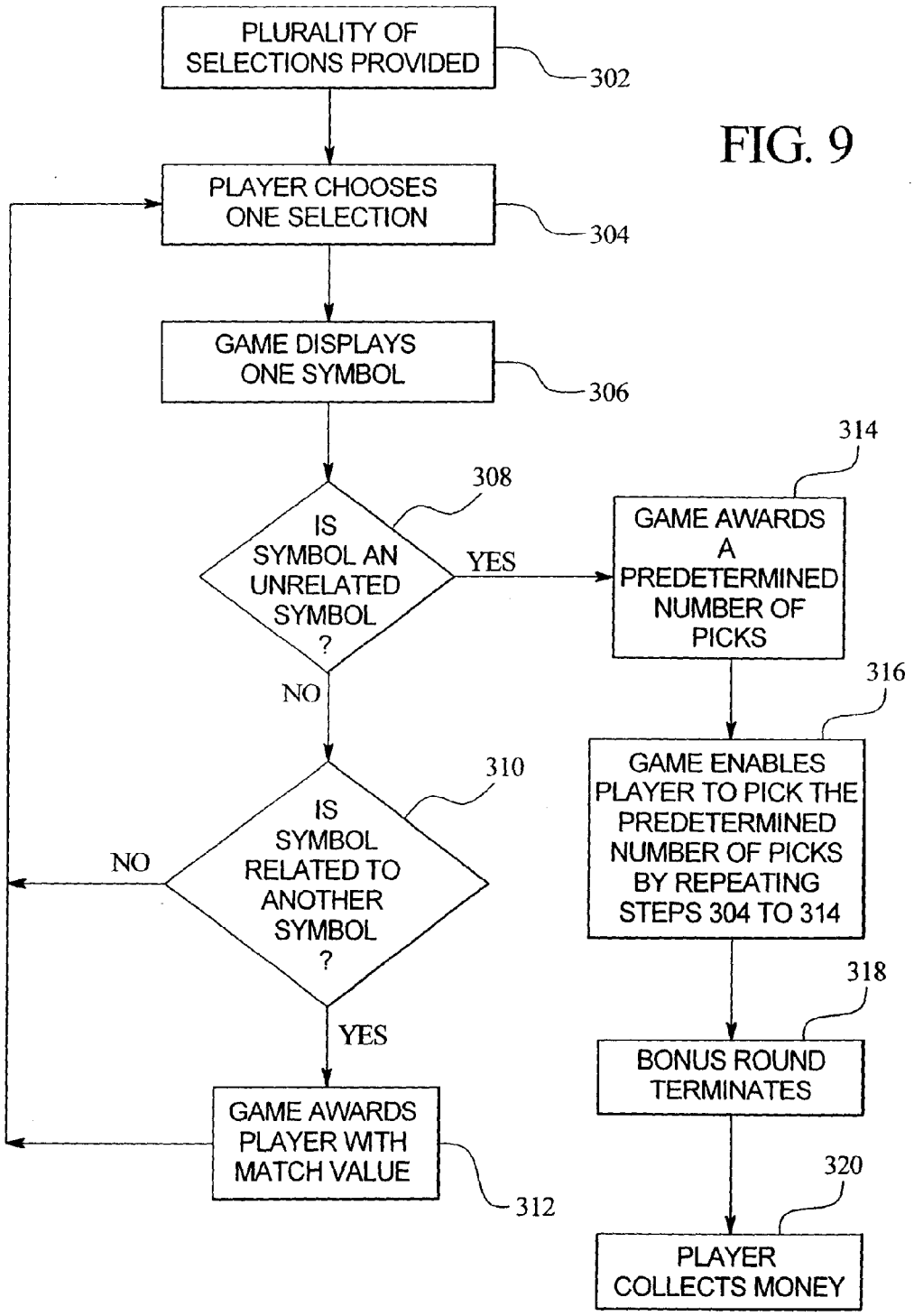

In yet another alternative embodiment of the present invention, when a player chooses certain non-terminating unrelated symbols, the game implements a predetermined termination scheme. The termination scheme causes the bonus round to terminate in a certain manner. For example, one termination scheme could be that the bonus round will terminate the next time the player reaches a match of symbols as shown by steps 114 and 116 in the flow chart illustrated in FIG. 7. In another example, a termination scheme could be that the bonus round will terminate after the player makes a predetermined number of choices of selections as illustrated in FIGS. 8 and 9. For instance, after a player chooses three more selections, the bonus round terminates. It should be appreciated that the game can implement other termination schemes in this alternative embodiment.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a plurality of selections;

a plurality of symbols, wherein each of said symbols is associated with one of said selections and at least one pair of said symbols is related;

at least one basic value associated with each of said symbols;

at least one match value associated with the pair of related symbols;

at least one display device adapted to display the selections and the symbols to a player; and a processor operable with the display device to enable the player to pick a plurality of selections, cause the symbol associated with the player picked selection to be displayed on the display device, award the player with the basic value associated with the symbol, award the player the match value when the pair of related symbols is displayed by the display device, and increase the basic values associated with each of said unpicked symbols when the pair of related symbols is displayed by the display device.

2. The gaming device of claim 1, which includes a plurality of pairs of related symbols.

3. The gaming device of claim 2, wherein the match values associated with any pairs of related symbols which are not displayed increase when said basic values associated with the unpicked symbols increase.

4. A method for playing a game of a gaming device, said method comprising the steps of:

(a) displaying a plurality of selections for a player to select, wherein each selection is associated with one of a plurality of symbols and at least one pair of the symbols is related;

(b) enabling the player to pick at least one of the selections and displaying the symbol associated with said selection;

(c) awarding the player at least one basic value associated with the displayed symbol;

(d) if the pair of related symbols is displayed, awarding the player at least one match value associated with the two related symbols;

(e) if the pair of related symbols is displayed, increasing the basic value associated with each unpicked symbol; and (f) repeating steps (b) to (e) at least once.

5. The method of claim 4, wherein the match value associated with any pairs of symbols which are not displayed also increases when the basic value increases.

6. The method of claim 4, which includes the step of operating the gaming device through a data network.

7. The method of claim 6, wherein the data network is an internet.

8. The method of claim 4, wherein computer instructions for implementing steps (a) to (f) are stored in a memory device.

* * * * *

UNITED STATES PATENT AND TRADEMARK OFFICE

CERTIFICATE OF CORRECTION

PATENT NO. : 6,669,559 B1
DATED : December 30, 2003
INVENTOR(S) : Baerlocher et al.

It is certified that error appears in the above-identified patent and that said Letters Patent is hereby corrected as shown below:

Drawings,
Please replace Figure 9 with the attached replacement Figure 9.

Signed and Sealed this

Tenth Day of August, 2004

JON W. DUDAS
*Acting Director of the United States Patent and Trademark Office*